United States Patent [19]

Jette

[11] 4,311,279

[45] Jan. 19, 1982

[54] WATER FLOW CONTROL DEVICE FOR A SHOWERHEAD

[76] Inventor: Emile Jette, 1328 NE. 110 Ter., Miami, Fla. 33161

[21] Appl. No.: 41,055

[22] Filed: May 21, 1979

Related U.S. Application Data

[63] Continuation-in-part of Ser. No. 971,051, Dec. 19, 1978, abandoned, which is a continuation-in-part of Ser. No. 868,200, Jan. 9, 1978, which is a continuation-in-part of Ser. No. 863,694, Dec. 29, 1977, abandoned, which is a continuation-in-part of Ser. No. 818,441, Jul. 25, 1977, abandoned, which is a continuation-in-part of Ser. No. 790,277, Apr. 25, 1977, abandoned, which is a continuation-in-part of Ser. No. 743,766, Nov. 22, 1976, abandoned.

[51] Int. Cl.[3] ..... B05B 1/32

[52] U.S. Cl. ..... 239/562; 239/578; 239/582; 239/587; 251/304; 251/310

[58] Field of Search ..... 239/562, 578, 581, 582, 239/587; 251/304, 309, 310

[56] References Cited

U.S. PATENT DOCUMENTS

| | | | |
|---|---|---|---|
| D. 161,431 | 1/1951 | Derbyshire | D23/35 |
| 1,239,870 | 9/1917 | Bradford | 251/309 |
| 1,354,291 | 9/1920 | Fraser | 239/562 |
| 2,776,168 | 1/1957 | Schweda | 239/587 |
| 3,052,445 | 9/1962 | Kessler | 251/309 |
| 4,013,230 | 3/1977 | Gondek | 239/587 |

FOREIGN PATENT DOCUMENTS

| | | | |
|---|---|---|---|
| 519522 | 12/1955 | Canada | 239/587 |
| 48234 | 11/1888 | Fed. Rep. of Germany | 251/309 |

*Primary Examiner*—Andres Kashnikow
*Assistant Examiner*—Michael J. Forman
*Attorney, Agent, or Firm*—Bacon & Thomas

[57] ABSTRACT

A showerhead control device which includes a connector fitting, a tubular body and an elongate operater handle extending downwardly and generally outwardly therefrom to permit a user to selectively position said showerhead device to direct a water discharge flow therefrom to a desired area or location, and a valve structure in the device controlled by the operater handle to, selectively shut off and turn on a water supply by movement thereof from an "on" position to an "off" position. This is accomplished without disrupting the hot and cold water mixture in the supply conduit to the showerhead. The device includes a first portion for threaded engagement with the water supply line, a second portion carrying conventional showerhead spray structure with a universal joint connection between the first and second portions and a third portion for regulating the water flow through a passage in the second portion by means of a valve structure, and for positioning the direction of the shower spray.

10 Claims, 5 Drawing Figures

WATER FLOW CONTROL DEVICE FOR A SHOWERHEAD

CROSS-REFERENCES TO RELATED APPLICATIONS

This application is a continuation-in-part of Application Ser. No. 971,051, filed Dec. 19, 1978, now abandoned, which is a continuation-in-part of Application Ser. No. 868,200, filed Jan. 9, 1978, which is a continuation-in-part of Application Ser. No. 863,694, filed Dec. 29, 1977, now abandoned, which is a continuation-in-part of Application Ser. No. 818,441, filed July 25, 1977, now abandoned, which is a continuation-in-part of Application Ser. No. 790,277, filed Apr. 25, 1977, now abandoned, which is a continuation-in-part of Application Ser. No. 743,766, filed Nov. 22, 1976, now abandoned.

FIELD OF THE INVENTION

This invention pertains to showerheads and, more particularly, to a water flow control device providing an elongate control operater handle, to determine the showerhead spray direction relative to a user and including a valve structure whereby the water flow therethrough may be selectively turned on and shut off by movement of the operater handle to an in use or neutral position.

BACKGROUND OF THE PRESENT INVENTION

Showerheads are generally connected to a source of water supply by a ball and socket connection or universal joint. The ball, in a conventional installation, is fixed to the end of a water supply line in a bathtub or shower enclosure.

This invention pertains to a device to be connected in fluid flow relation between the water supply line and a showerhead and which includes a valve means operable by a remote control operater handle for selectively opening and closing the flow path through a device portion and hence the water supply to the showerhead spray structure.

The instant invention includes a ball and socket connecter fitting, a tubular body portion and an elongated control operater with an enlarged protective hand grip, whereby the relative movement for opening and closing a valve means may be achieved by manipulation of a hand grip at the extended terminal end of the elongated operater, which is conveniently located remote from the shower spray.

Generally, individual hot and cold faucets or a single lever type of faucet is connected to hot and cold water pipe lines from a source of supply. The faucet or faucets must be manipulated to a proper hot and cold water mixture to achieve a desired water temperature. The mixed water then enters a single conduit to the showerhead where it passes through a discharge port in the connector ball and then outwardly in a spray form through any one of a variety of spray structures depending upon the maker of the spray head.

To adjust the direction of spray, a user must physically grasp any of the single or multiple outlet spray heads provided with the above-described ball and socket connections and turn it to a desired position.

Generally the water will be left running when users are lathering or washing their hair, wasting a measurable amount of water and energy to heat the water, or if a user desires to shut off the water supply while "soaping up" or shampooing his or her hair, the faucet or faucets must be turned off and then uncomfortably turn the hot and cold water back on again and readjust to a desired hot and cold water mixture for the rinsing-off operation. Particularly in relatively small bathtubs and shower enclosures, generally provided in most bathrooms, it is very difficult to avoid contact by the shower spray while soaping-up or shampooing the hair.

The device of the present invention provides an elongated remote control operater handle, generally in the form of a rod, with an enlarged protective hand grip on the extended terminal end, with an inner end fixed relative to the device in a manner so as to permit rotational movement thereof to permit a user to shut off or turn on the water flow through the device and to universally position the showerhead spray. The connection of the elongated control handle to the tubular body is formed in a manner so as to provide rotational shut-off valving means, when the valve structure by means of the extended operater handle, is turned to a position wherein the tubular body flow through path is closed by the control handle valve portion. This is accomplished without upsetting the hot and cold water mixture, and a user need only to rotate the valve control operater handle to first and second position to shut the water off, and to turn the water on again. The faucet or faucets need no further manipulations and, if desired, a user or users need never operate the faucet or faucets to off positions. The water flow may be shut off by means of the adapter and on each subsequent use, the adapter may be manipulated to an "on" position and immediately provide water of the desired temperature previously regulated.

Therefore, one of the principal objects of the present invention is to provide a water flow control device, including a valve structure therein, operable through on and off zones in a predetermined range of movement by an operater control handle means, to selectively open or close a water flow path therethrough, when the valve structure is rotated to an "on" position second zone, in said range of movement, and to turn off the flow of water when said operater is turned to an "off" position first zone within the movement range.

Another principal object of this invention is to provide a generally downwardly extending operater handle means in the form of an elongated extension rod diverging from an axial centerline through the tubular body thereof to permit a predetermined degree of universal manipulation of the direction of the spray dispersement.

Another object of the invention is to provide an "on" and "off" valve means completely independent of the faucet or faucets controlling the flow of hot and cold water from sources of supply.

A further object of the invention is to provide an enlarged protective hand grip control on an extended terminal end of the operater handle.

DESCRIPTION OF PREFERRED EMBODIMENT

Figure 1:
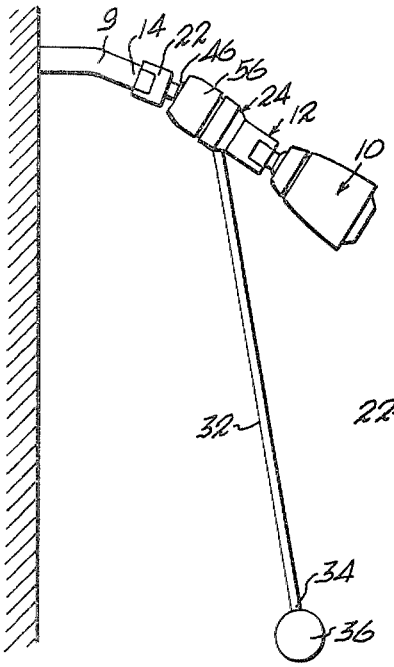
FIG. 1 is a side elevation view illustrating the installation of the instant invention.

Referring to the drawings wherein like reference characters designate like or corresponding parts throughout the several views, there is shown in FIG. 1 a waterline supply pipe generally designated by the numeral 9 and a showerhead structure generally designated by the numeral 10. Conventionally a showerhead structure 10 is provided with a female coupling 12 for threaded engagement on the outer terminal end zone 14 of a water supply pipe; the showerhead female coupling is internally threaded as at 16 for threaded engagement on the threaded end of the water supply line in a conventional installation.

The present invention pertains to a water flow control device generally designated by the numeral 20 which, as shown in the drawings, may be interposed between the water supply line pipe 9 and the female coupling 12 of the showerhead structure.

One form of the device is composed, generally of three principal portions: first, any appropriate fitting 22 adapted for threaded engagement with a water supply line 9; second, a tubular body 24 provided with an open front end nose portion 26 having external threads 28 for threaded engagement in the female recess of the showerhead coupling 12, and a swivel means portion, which may be in the form of a conventional ball and socket type connection 30 as shown, which interconnects the fitting 22 and the tubular body 24 to permit a range of relative universal movement, and third, an elongated control rod 32 of a predetermined length, having a minor inner length and a major outer length with an outer end portion 34, which may be screwthreaded for attachment of an enlarged protective hand grip portion such as knob 36, and a spherical knob inner end portion at 38, somewhat enlarged relative to the diameter of rod 32.

A valve 40 is defined in rod 32 by a cut out portion of a predetermined length and depth along a plane 42, on or adjacent to a diametric plane of rod 32. The valve cut out 40 angularly bisects a main water flow passage 44 through tubular body 24. Passage 44 communicated between a water path opening 46 through a ball 48 of connection 30 to the showerhead 10 in a manner to be subsequently described.

Ball 48 is captivated in a socket having an inner portion 50 defined in a rear end portion 52 of tubular body 24 and an outer portion 54 defined within a keeper cap 56 screwthreaded at 58 on a rear end portion 52 of tubular body 24 with a generally O-ring type of water seal 60 interposed therebetween. An enlarged flow through chamber 62 is formed in the tubular body 24 between passage 44 and ball water path opening 45 to permit a predetermined range of swivel movement of the body portion 24 while maintaining an open flow through chamber from the supply pipe 9 through the showerhead 10.

Figure 2:
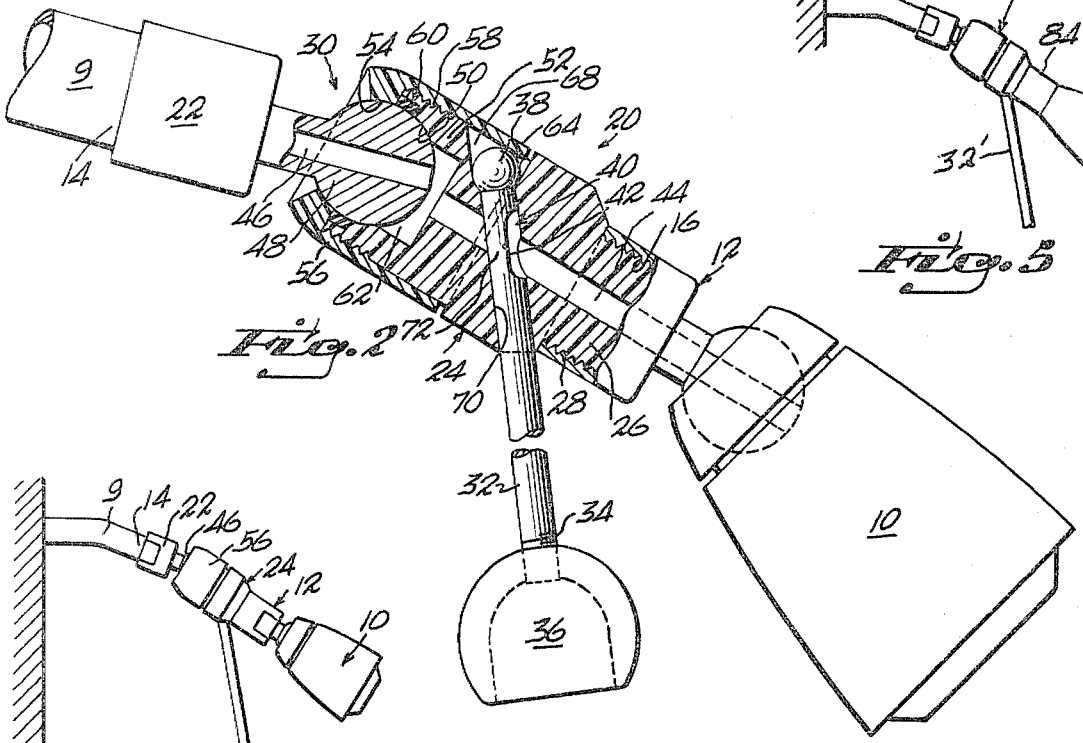
FIG. 2 is a view which is partly in cross section of the showerhead device shown in FIG. 1.
Figure 3:
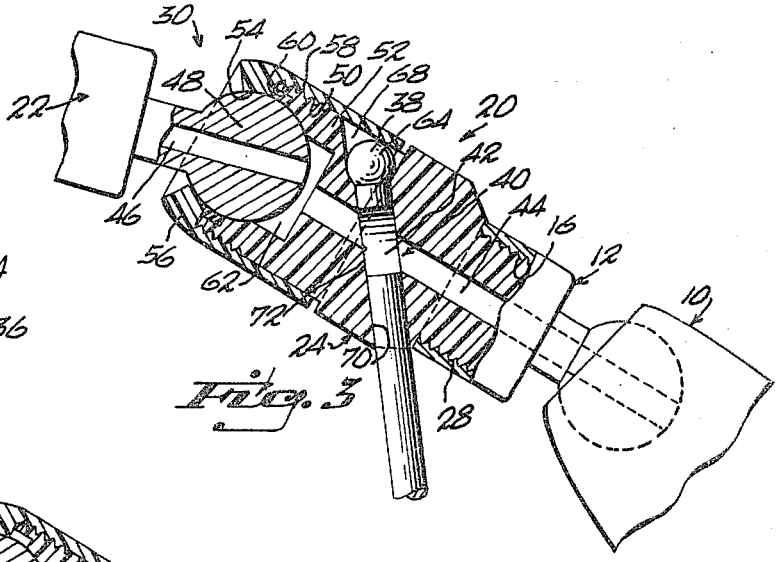
FIG. 3 is a view in cross section similar to FIG. 2 and illustrating the device in a flow through or on position in contrast to the closed position of the water flow in FIG. 2.

As illustrated in FIGS. 2 and 3, a forwardly projecting annular skirt 64 from cap 56 forms a closure for a recess 68 defined in tubular body 24, to captivate the enlarged inner spherical knob end 38 of control rod 32. For assembly purposes, the cap 56 is removed from the tubular body 24 and the hand grip knob 36 is removed from the rod 32 which is inserted in recess 68 and slid through a bore 70, angularly formed relative to, and bisecting the main water flow passage 44. When the cap 56 is replaced, the rod 32 is captivated in an operating position as illustrated in the drawings.

The diameter of the bore 70 is designed to snugly rotatably journal the rod 32 and preferably at least slightly enlarged relative to the diameter of main water flow passage 44. The valve cut out 40 is of a depth so as to provide a rod span portion 72 which closes main water flow passage 44 in a first zone position of FIG. 2, and opens the main water flow passage through the cut out 40 in the second zone position of FIG. 3, upon a 90 degree rotation of rod 32 by means of hand grip knob 36.

Figure 4:
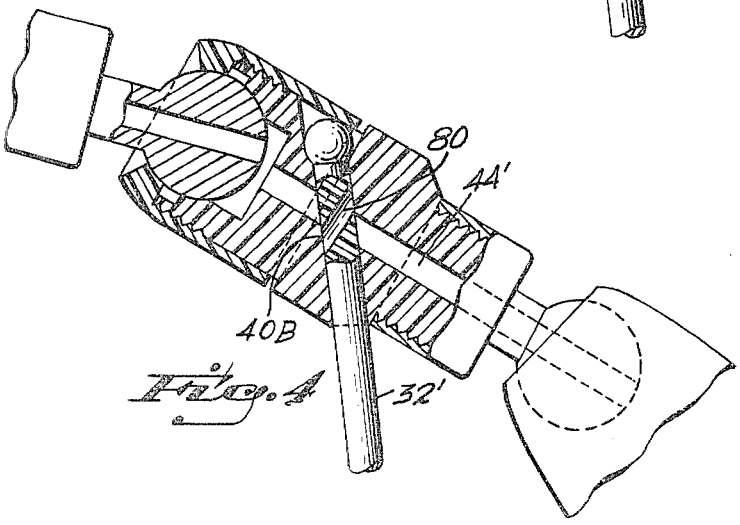
FIG. 4 is a view, partly in cross section and similar to FIG. 2, illustrating a modified valve structure in a closed position.

In a somewhat modified form of the invention disclosed in FIG. 4, a cut out 40B in the form of an angularly disposed hole 80 is provided through rod 32'. Hole 80 is positioned to block a water flow through main water flow passage 44' in the closed position illustrated. When operater rod 32' is rotated through 180 degrees from the position illustrated, the hole 80 aligns with passage 44' to permit a water flow therethrough to the showerhead spray structure.

The device 20 as above described is in the general nature of an adapter and provides the advantages of permitting persons, having favorite types of single or multiple types of showerheads, to interpose the device of the present invention between the water supply outlet and an existing favored showerhead to take advantage of the approximately 50 percent savings in water as well as the attandent energy savings relative to heating the water saved.

However, as illustrated in FIG. 1, any of a number of generally conventional types of showerheads 10 may be provided for direct screwthreaded attachment to the nose portion 26 as by a coupler 12.

Figure 5:
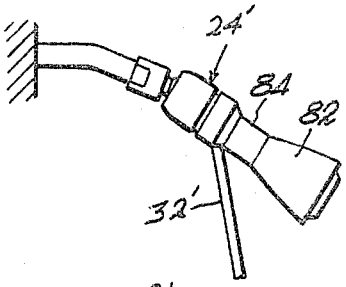
FIG. 5 is a side elevation view similar to FIG. 1 illustrating a further modified form of the invention.

Alternatively, as illustrated in FIG. 5, the outer shell spray means portion of the showerhead 82 may be intergrally molded with the tubular body 24' as at 84 with conventional spray elements assembled therein.

In all of the various forms of the invention, a predetermined tolerance connection is provided between the surfaces of main flow through passage 44 and rod 32 at their intersection to provide a trickle leak to aid in preventing cross flow in the hot and cold water lines, in the valve "off" zone position, in the event of an imbalance in water pressure in the respective lines.

What is claimed is:

1. A device for controlling both flow and direction of water through a showerhead from a supply line, which device comprises:

(a) a base member having a longitudinal flow passage therethrough;

(b) first means for pivotally connecting the base member to the supply line for receiving water through one end of the flow passage;

(c) second means for connecting the showerhead to the base member for directing water out the other end of the flow passage to the showerhead;

(d) an elongated control rod for pivoting the base member about the first pivotal connection means to control the direction of water flow from the showerhead, which control rod includes:

i. a first end rotatably journaled within the base member and including a valve passageway therethrough, with the longitudinal axes of the flow passage and control rod intersecting each other to define an acute angle which diverges outwardly from the first pivotal connection means, whereby water flow is permitted through the valve passageway in at least one position of rotation of the control rod and at least substantially terminated in at least one other position of rotation of the control rod, and ii. a free distal end; and (e) means for retaining the first end of the control rod within the base member.

2. The device of claim 1 wherein the valve passageway is substantially cylindrical in configuration and extends completely through the control rod.

3. The device of claim 1 wherein the control rod is of a substantially cylindrical configuration and the passageway is defined by a chordal cut-out portion on one side of the rod.

4. The device of claim 1 wherein the control rod includes a handle adjacent its distal free end for actuation of the rod.

5. The device of claim 1 wherein the base member includes a recess and the retaining means includes an enlarged portion carried by the first end of the control rod and disposed within the recess.

6. The device of claim 1 wherein the first pivotal connection means includes a ball and socket joint for permitting substantially universal pivotal movement of the base member.

7. The device of claim 6 wherein the base member includes an internal surface section which defines at least a portion of the socket, with the surface section including an extended chamber to permit uninterrupted water flow from the supply line through the one end of the flow passage within substantially the entire range of pivotal movement of the base member.

8. The device of claim 6 wherein the first pivotal connection means further includes a threaded cap having an internal surface which defines a portion of the socket.

9. The device of claim 1 wherein the second connection means includes a threaded portion provided on the base member for threadedly attaching the showerhead thereto.

10. The device of claim 1 wherein the valve passageway permits a trickle of water flow therethrough when the control rod is in the one other position of rotation.

* * * * *